US005530464A

United States Patent [19]

Hiwada

[11] Patent Number: 5,530,464

[45] Date of Patent: Jun. 25, 1996

[54] IMAGE FORMING APPARATUS FOR FORMATTING IMAGE BY CONTROLLING ELECTRIC FIELD

[75] Inventor: Shuhei Hiwada, Toyoake, Japan

[73] Assignee: Brother Kogyo Kabushiki Kaisha, Nagoya, Japan

[21] Appl. No.: 50,616

[22] Filed: Apr. 22, 1993

[30] Foreign Application Priority Data

May 19, 1992 [JP] Japan ..... 4-125760

[51] Int. Cl.[6] ..... B41J 2/415

[52] U.S. Cl. ..... 347/55

[58] Field of Search ..... 346/140 R, 159, 346/1.1, 154; 355/261, 262; 358/298, 300, 302; 347/55, 11–13, 15, 112, 120, 128, 143, 144

[56] References Cited

U.S. PATENT DOCUMENTS

| | | | |
|---|---|---|---|
| 3,689,935 | 8/1972 | Pressman et al. | 346/159 |
| 4,074,319 | 2/1978 | Goldschmidt et al. | 358/302 |
| 4,368,491 | 1/1983 | Saito | 358/298 X |
| 4,755,837 | 7/1988 | Schmidlin et al. | 346/155 |
| 4,912,489 | 3/1990 | Schmidlin | 346/159 |
| 4,918,462 | 4/1990 | Tomita et al. | 346/107 R |
| 5,036,341 | 7/1991 | Larsson | 346/154 |
| 5,040,004 | 8/1991 | Schmidlin et al. | 346/159 |
| 5,099,271 | 3/1992 | Maeda et al. . | |
| 5,128,695 | 7/1992 | Maeda | 346/140 R |
| 5,153,611 | 10/1992 | Kokado et al. | 346/140 R |
| 5,231,427 | 7/1993 | Ohashi | 346/159 X |

FOREIGN PATENT DOCUMENTS

| | | | |
|---|---|---|---|
| 53-11532 | 2/1978 | Japan | 347/15 |

OTHER PUBLICATIONS

Continuous–Tone Photographic Image Reproduction Using Ion Flow Printing Process, M. Omodani et al., Journal of Imaging Technology, vol. 16, No. 4, pp. 153–157, Aug. 1990.

*Primary Examiner*—Benjamin R. Fuller
*Assistant Examiner*—Alrick Bobb
*Attorney, Agent, or Firm*—Oliff & Berridge

[57] ABSTRACT

In an image forming apparatus for performing gradation representation and using a resolution-excellent aperture electrode member, a conductive drum is disposed at the upper side of the control electrodes of an aperture electrode member, and a toner stirring device is disposed at the lower side of a reference electrode of the aperture electrode member. A control unit 13 for generating timing signals g and h on the basis of a control signal f input from an image data generating device is connected to a pulse generating unit 11. The timing signal g serves as a shift clock for a shift register, and the timing signal h serves as a clear clock for the shift register and a setting clock for a rate multiplier.

24 Claims, 9 Drawing Sheets

IMAGE FORMING APPARATUS FOR FORMATTING IMAGE BY CONTROLLING ELECTRIC FIELD

BACKGROUND OF THE INVENTION

1. Field of the Invention

This invention relates to an image forming apparatus, and more particularly to the improvement of an image forming apparatus for applying an electric field to an aperture to allow charged toner particles to fly or pass through the aperture thereby forming an image on an image support member.

2. Description of Related Art

There has been conventionally known one type of image forming apparatus having an aperture electrode member. FIG. 9 shows a conventional aperture electrode member 50 of this type.

As shown in FIG. 9, the aperture electrode member 50 includes an insulating layer 52, a reference electrode 53 which is continuously formed on one surface of the insulating layer 52, and control electrodes 54 which are formed on the other surface of the insulating layer 52 so as to be electrically insulated from one another. That is, the aperture electrode member 50 is so designed that the insulating layer 52 is sandwiched between the reference electrode 53 and the control electrodes 54. In addition, at least one array of apertures 55 are formed at positions corresponding to the respective insulated control electrodes 54 so as to penetrate through the three layers (reference electrode, insulator and control electrode). This array of apertures 55 (hereinafter referred to as "aperture array") is formed over the whole width of the image support member (copy sheet, not shown). This type of aperture electrode member is disclosed in U.S. Pat. No. 5,099,271.

A voltage is selectively applied between the control electrodes 54 and the reference electrode 53, using the aperture electrode member 50 having the above construction, to control the passage of toner particles (not shown) through the apertures 55. The image support member and the aperture electrode member 50 are moved relative to one another to position the image support member in a toner-particle flowing passageway and a desired image is formed on the image support member.

In the image forming apparatus using the aperture electrode member 50, as described above, formation of an image on the image support member having gradation has been performed using conversion means, for converting image data containing gradation data input from an external source into binary image-forming data. Such a printer could most probably use a dither method, which is an areal gradation method (shown in FIGS. 10A and 10B) for printing such as is used with dot matrix and laser printers, using voltage applying means for selectively applying a voltage to each of the control electrodes on the basis of the image data.

Means for determining the density of the areal gradation as described above will be described with reference to FIGS. 10A and 10B.

As shown in FIG. 10A, for example, in order to form a capital letter C as an image, plural picture elements are arranged in a C-shaped form, and each of the picture elements is provided with density. Each picture element comprises plural dots, for example, 4×4 dots each corresponding to each aperture. The gradation (light and shade) of each picture element is represented (adjusted) in accordance with the number of dots to be smeared (blackened) for each picture element. That is, in FIG. 10B, the density of the picture element is gradually heightened toward the right-hand picture element.

However, a large number of dots must be used to perform gradation representation in the conventional areal gradation method. In order to obtain 64-step gradation for example, an 8×8 dot matrix is required. An image forming apparatus having 16 dots/mm resolution provides an output image of 2 picture elements/mm when 8×8 dot matrix is used, and thus there occurs a problem that the resolution is greatly degraded.

SUMMARY OF THE INVENTION

An object of this invention is to provide an image forming apparatus with a excellent resolution aperture electrode member in which gradation representation can be performed.

In order to attain the above object, the image forming apparatus according to this invention comprises an insulator layer, a reference electrode which is continuously formed on one surface of the insulator layer, plural control electrodes which are individually formed on the other surface of the insulator layer so as to be insulated from one another, an aperture electrode member having apertures which are formed for every control electrode so as to be penetrated through the three layers of the reference electrode, the insulator layer and the control electrodes, supply means for supplying charged toner in the vicinity of the apertures of the reference electrode, pulse generating means for generating a pulse corresponding to density data of an image signal which is supplied from an external source, and applying means for applying a control voltage corresponding to the pulse generated in the pulse generating means between the control electrodes and the reference electrode.

The pulse generating means generates pulses whose number corresponds to a data value representing the image density of the image signal, for example. The applying means applies the control voltage between each of the control electrodes and the reference electrode a predetermined number of times which correspond to the number of the pulses (pulse number) generated in the pulse generating means. Therefore, a toner supply (adherence) amount at the same dot position on the image support member is proportional to the pulse number, and thus the density is heightened as the pulse number is increased while the density is lowered as the pulse number is decreased. Therefore, the gradation control can be performed and an image having a desired gradation can be formed on the image support member.

BRIEF DESCRIPTION OF THE DRAWINGS

Preferred embodiments according to the invention will be described hereunder with reference to the accompanying drawings in which:

FIG. 10A is a diagram showing a case where a capital letter C is constructed by picture elements and FIG. 10B is a diagram showing the density gradation of the above picture elements.

DETAILED DESCRIPTION OF PREFERRED EMBODIMENTS

Figure 1:
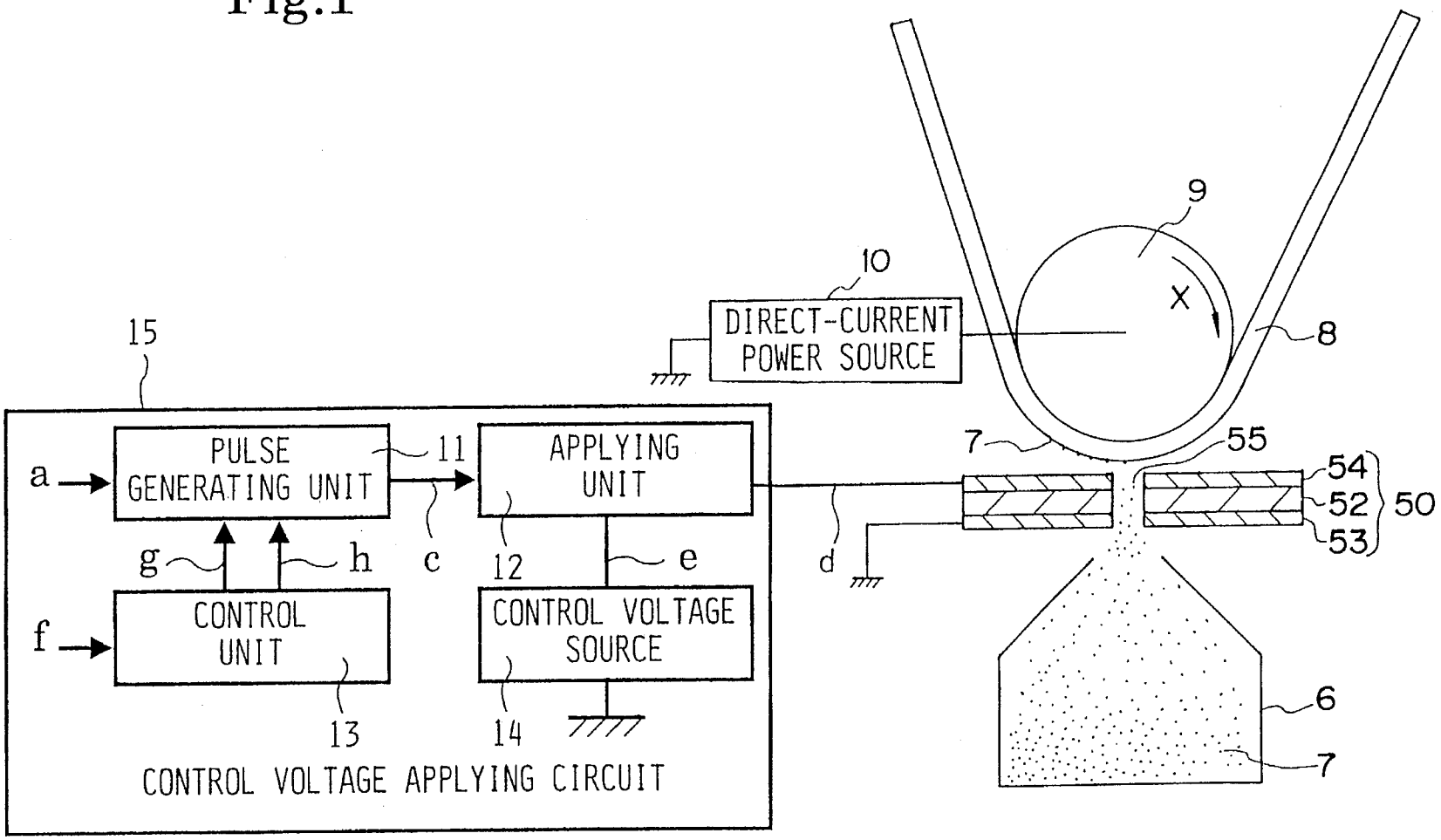
FIG. 1 is a cross-sectional view of a main part of a first embodiment according to the invention, partially containing a block diagram of elements of the first embodiment.

In the following description, the same elements are represented by the same reference numerals and duplicate description is omitted.

The structure of a main part of a first embodiment of an image forming apparatus will be described with reference to FIG. 1.

As shown in FIG. 1, a conductive drum 9 serving as a backside (counter) electrode is disposed at the upper side of the control electrodes 54 of the aperture electrode member 50. A toner stirring device 6 storing toner 7 is disposed at the lower side of the reference electrode 53 of the aperture electrode member 50. A toner supply device (not shown) is disposed inside of the toner stirring device 6 and the cloud-like toner, which is charged by action of the toner stirring device 6, is supplied to the vicinity of the apertures 55 of the reference electrode 53. This type of toner supply device is disclosed in U.S. Pat. No. 5,099,271, the disclosure of which is incorporated by reference.

The conductive drum 9 is connected to a direct-current power source 10, and serves to carry the image support member 8 in a direction as indicated by an arrow X (in a clockwise direction) while in contact with the image support member 8.

A control unit 13 for generating timing signals g and h on the basis of a control signal f which is input from an image data generating device (not shown), is connected to a pulse generating unit 11 for generating a group of signals as described below. The timing signal g serves as a shift clock for a shift register 30 as described below and the timing signal h serves as a clear clock for the shift register 30 and a setting clock for a rate multiplier 32.

Next, the detailed structure of the pulse generating unit 11 will be described with reference to FIG. 2.

Figure 2:
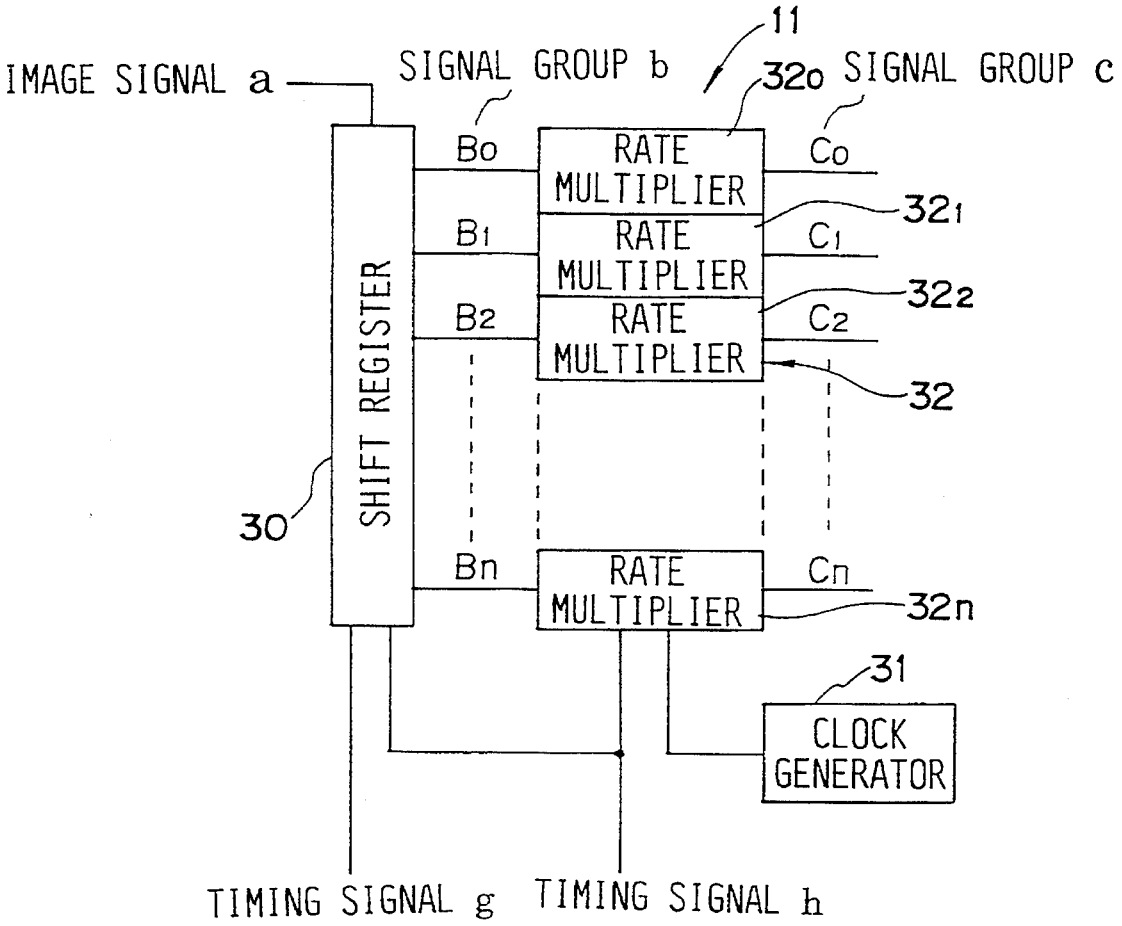
FIG. 2 is a schematic diagram of a pulse generating means of the embodiment.

As shown in FIG. 2, the pulse generating unit 11 comprises the shift register 30 whose stage number is equal to the number of apertures 55, a clock generator 31 for generating a reference clock, and plural rate multipliers $\mathbf{32}_0$, $\mathbf{32}_1$, $\mathbf{32}_2$, . . . , $\mathbf{32}_n$ (n is an integer) which are provided to the respective apertures.

The shift register 30 is input with image signals a of 8-bit width which are successively output from the image data generating device. As described below, the shift register 30 serves to convert light-and-shade (density) data contained in the image signals a to a group of 8-bit width parallel signals b (signals $B_0$, $B_1$, $B_2$, . . . , $B_n$) whose number is equal to the number of the apertures 55.

The rate multipliers $\mathbf{32}_0$, $\mathbf{32}_1$, $\mathbf{32}_2$, . . . , $\mathbf{32}_n$ are supplied with the parallel signals b to set these signals in a parallel-signal form and temporarily store the signals. Each rate multiplier 32 converts a clock signal generated in the clock generator 31 to pulses whose number corresponds to the value of each of the parallel signals and output these pulses as a signal group c (signals $C_0$, $C_1$, $C_2$, . . . , $C_n$).

Figure 3:
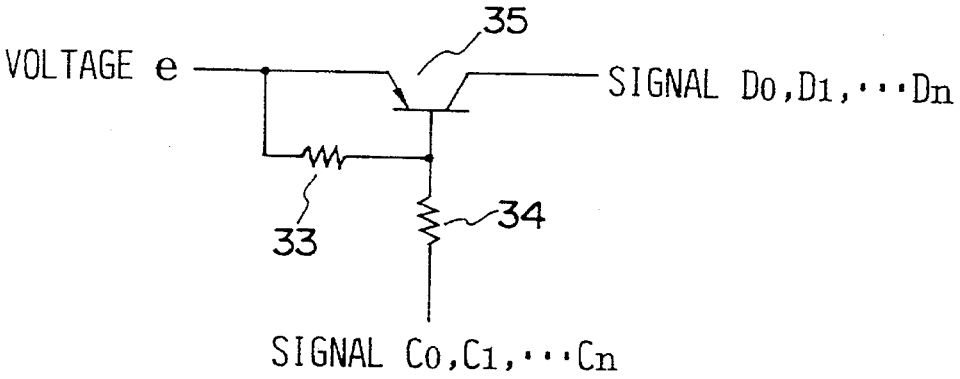
FIG. 3 is a schematic diagram of an applying means of the embodiment.

The applying unit 12 serves as a switch circuit, as shown in FIG. 3, comprising resistors 33 and 34 and a transistor 35. The same number of applying units 12 as there are control electrodes 54 of the aperture electrode member 50 are provided so that there is a one-to-one correspondence to the control electrodes 54. The applying units 12 serve to apply a control voltage, that is, a signal group d (signals $D_0$, $D_1$, $D_2$, . . . , $D_n$) between each control electrode 54 and the reference electrode 53 when supplied with the output signal group c of the pulse generating unit 11. A control voltage source 14 generates a voltage e and supplies it to the applying unit 12, as shown in FIG. 3.

Figure 4:
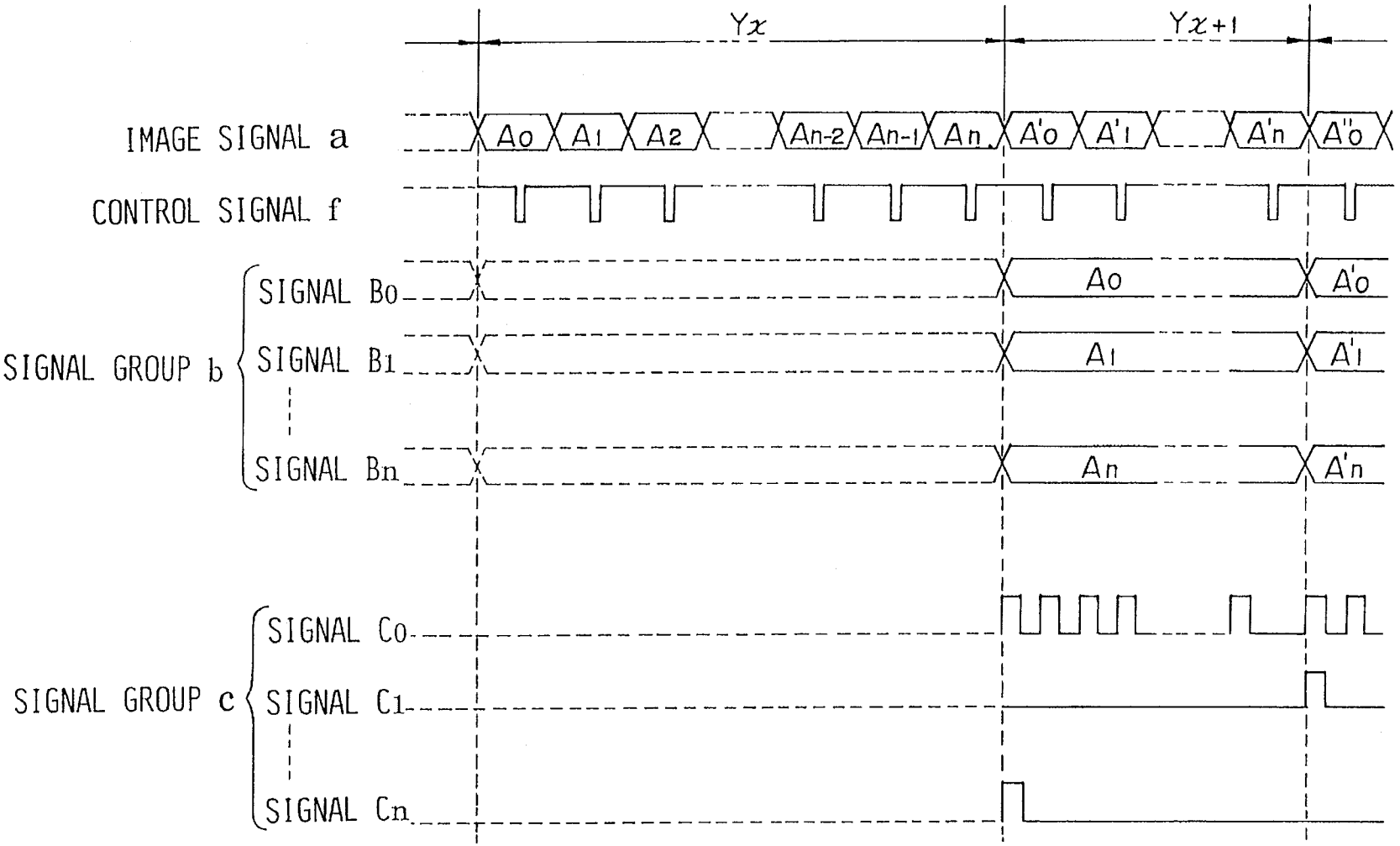
FIG. 4 is a timing chart for an operation of the embodiment.

The operation of the image forming device thus structured will be described with reference to the timing chart of FIG. 4.

The image signals a (light-and-shade data $A_0$, $A_1$, . . . , $A_n$) input from the image data generating device are shifted by the shift register 30 on the basis of the timing signals g and h, which are generated on the basis of the control signal f, and converted to the parallel signal group b of 8-bit (signals $B_0$, $B_1$, $B_2$, . . . , $B_n$) whose signal number is equal to the number of the apertures 55. The signals $B_0$, $B_1$, $B_2$, . . . , $B_n$ are input to the rate multipliers $\mathbf{32}_0$, $\mathbf{32}_1$, $\mathbf{32}_2$, . . . , $\mathbf{32}_n$ respectively, and set in a parallel-signal form. That is, each rate multiplier 32 serves to convert the clock signal generated in the clock generator 31 to pulses whose number corresponds to the value of each of the above set signals $B_0$, $B_1$, $B_2$, . . . , $B_n$ and output the pulses as a pulse signal group c (signals $C_0$, $C_1$, $C_2$, . . . , $C_n$). The signals $C_0$, $C_1$, $C_2$, . . . , $C_n$ are signals which will be transferred to an H-level state at N-times when the pulse number is "N" and, also, which will not be transferred to the H-level state but will be continuously kept in a L-level state when the pulse number is "0". That is, the rate multiplier 32 performs a Pulse Number Modulation in which the number of pulses having the same pulse width is varied.

The pulse signal group c is supplied to the applying unit 12 and pulses, whose number is indicated by each of the signals $C_0$, $C_1$, $C_2$, . . . , $C_n$, are applied as the signal group d to each of the control electrodes 54. For the signal $C_0$, for example, a number of pulses are applied between the control electrode 54 and the reference electrode 53 and the toner is supplied (attached) onto the image support member (not shown) through the aperture 55 as many times as the number of the pulses so that the density of an image at this position is heightened. On the other hand, for the signal $C_1$, no pulse is applied between the control electrode 54 and the reference electrode 53. Thus, no toner is attached onto the image support member. Further, for the signal $C_n$, the pulse is applied only once, and thus a very slight amount of toner is attached onto the image support member. Here, a section $Y_x$, as shown in FIG. 4, means a section for the light-and-shade (density) data $A_0$, $A_1$, $A_2$, . . . , $A_n$ of the image signal a.

As described above, by using the pulse generating unit 11 and the applying unit 12, the voltage having no dispersion can be applied to each control electrode 54 and the toner supply (flight) amount can be controlled in proportion to the pulse number applied to the control electrode 54.

Therefore, the toner supply (attaching) amount at the same dot position on the image support member can be adjusted as a gradation control in accordance with the pulse number. Accordingly, an output image having gradation representation can be obtained without degrading the resolution because the density of the same dot can be controlled.

Figure 5B:
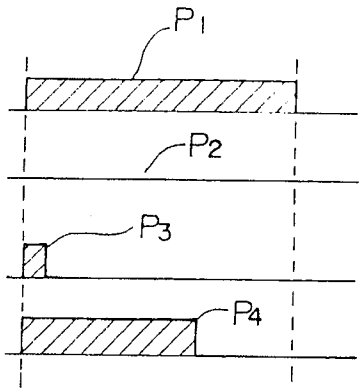
FIG. 5 is a timing chart for an operation of a modification of the embodiment.
Figure 5A:
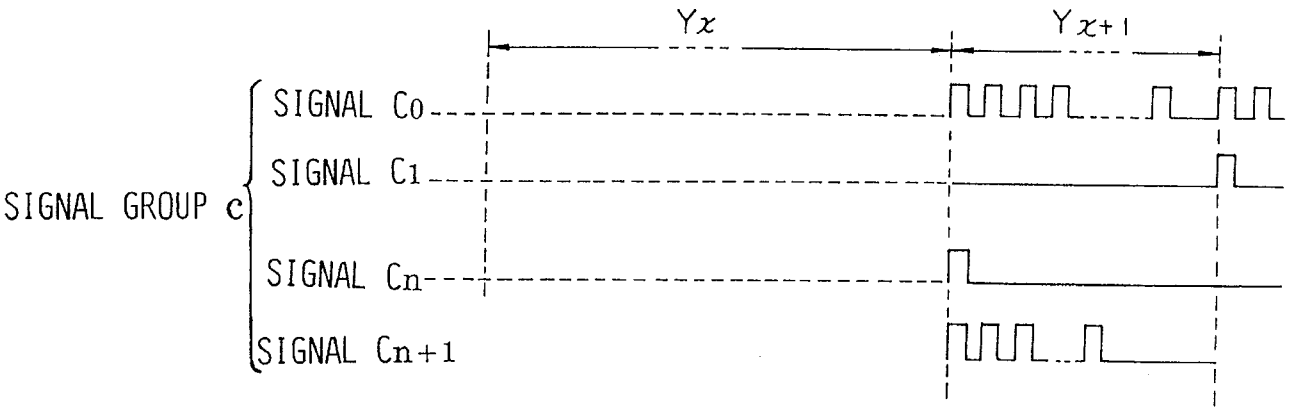

The description of the above embodiment is made in a case of PNW (Pulse Number Modulation). However, as shown in FIG. 5, a voltage having "pulse width $P_1$, $P_2$, $P_3$, $P_4$" which is proportional to the pulse number generated in the shift register 30 (see FIG. 2) may be applied to the control electrode 54 (see FIG. 1). That is, PWM (Pulse Width Modulation) may be adopted.

Next, a second embodiment of this invention will be described with reference to FIGS. 6 and 7.

Figure 6:
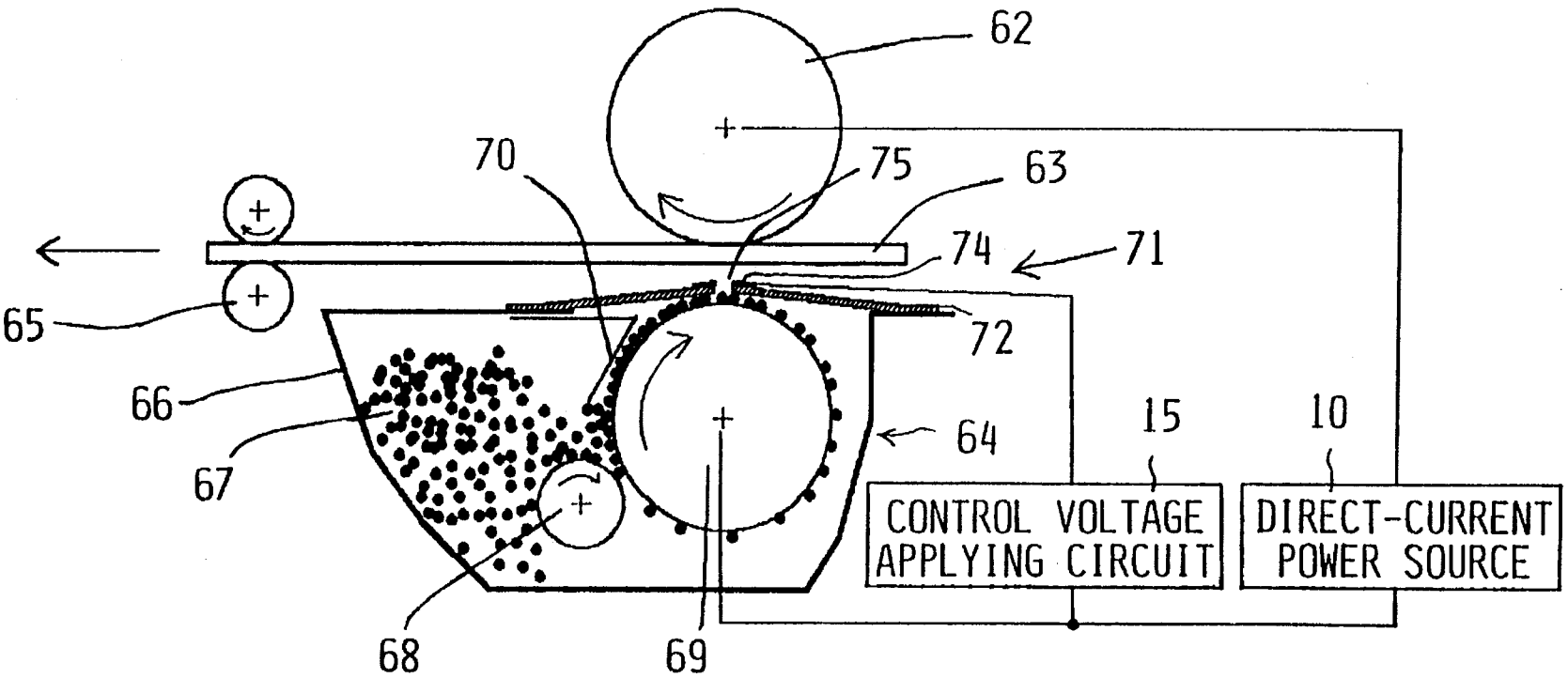
FIG. 6 is a cross-sectional view of a main part of a second embodiment according to the invention.

FIG. 6 is a schematic diagram of the image forming apparatus of the embodiment. In the image forming apparatus, a cylindrical backside (counter) electrode roller 62 is rotatably supported by a chassis (not shown) at the upper side of an aperture electrode member 71, serving as toner flow control means, and is disposed away from the aperture electrode member 71 at a 1 millimeter interval so as to carry an image support member 63 which is inserted into a gap between the aperture electrode member 71 and the backside (counter) electrode roller 62. A toner supply device 64 is disposed in the longitudinal direction of the aperture electrode member 71 at the lower side of the aperture electrode member 71. In addition, a fixing device 65 is disposed at the downstream side of the image support member 63 which is carried and fed by the backside (counter) electrode roller 62.

The toner supply device 64 comprises a toner case 66 which also serves as a housing for the whole of the device, toner 67 stored in the toner case 66, a supply roller 68, a toner carry roller 69, and a toner layer restricting blade 70. The toner carry roller 69 serves to carry the toner 67 and feed it toward the aperture electrode member 71. The supply roller 68 serves to supply the toner 67 to the toner carry roller 69.

The supply roller 68 and the toner carry roller 69 are rotatably supported in the directions as indicated by the arrows in FIG. 6 respectively, and are disposed in parallel to and in contact with each other. The toner layer restricting blade 70 is contacted with the toner carry roller 69 under pressure, and serves to adjust the amount of the toner to be carried by the toner carry roller 69 so that the toner is uniformly carried over the surface of the toner carry roller 69 and uniformly charges the toner.

Figure 7:
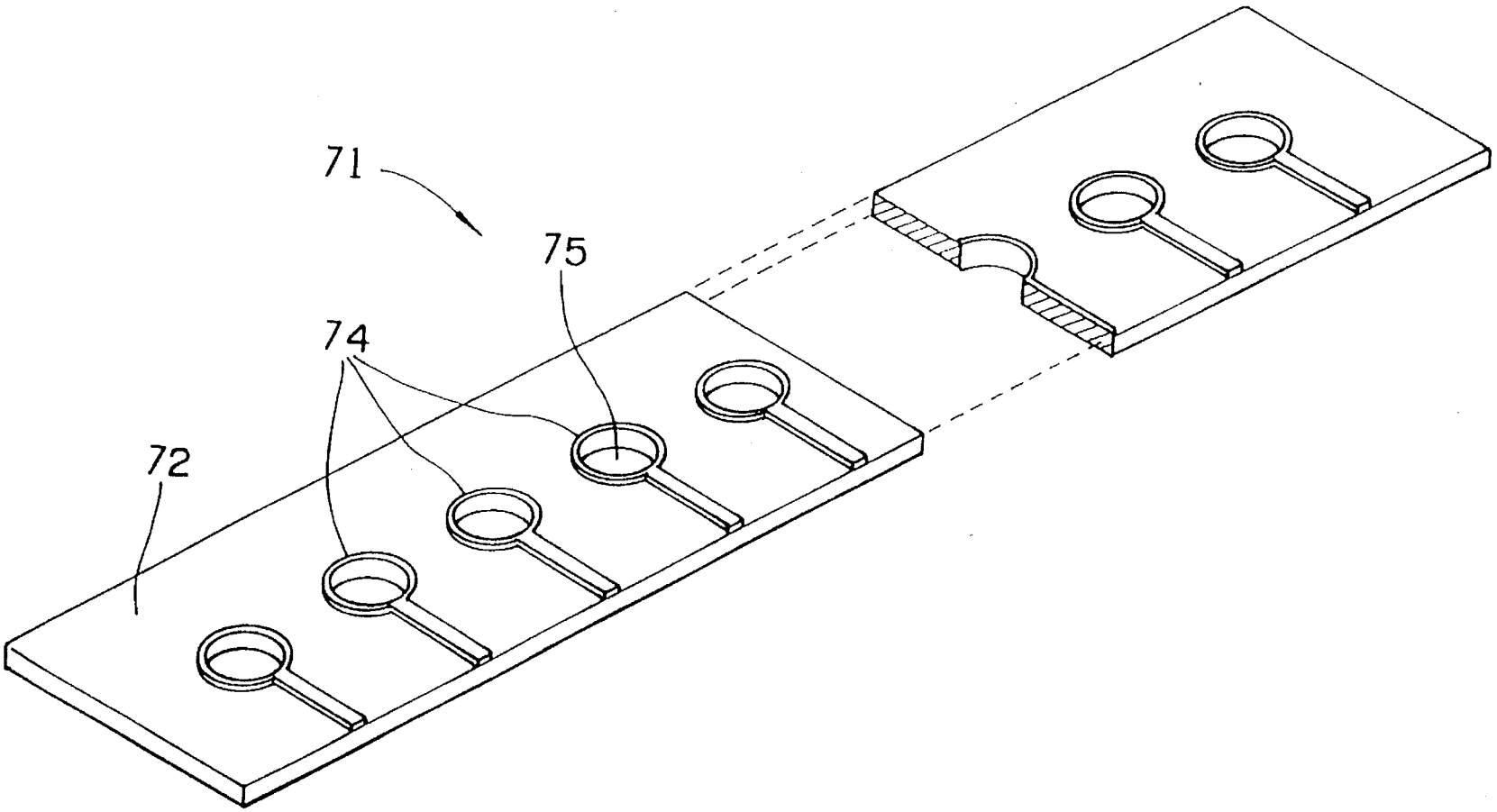
FIG. 7 is a perspective view of an aperture control electrode of the second embodiment.
Figure 8:
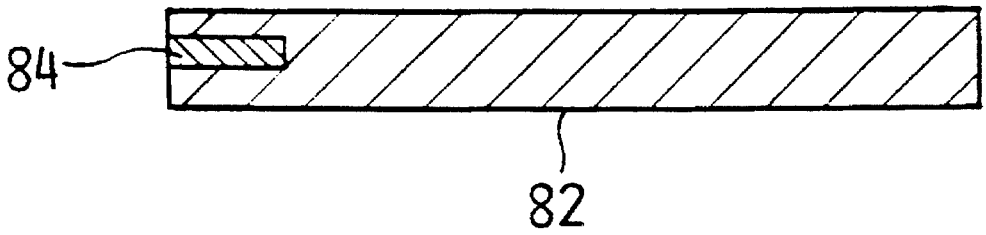
FIG. 8 is a side cross-sectional view of an embedded control electrode of the second embodiment.
Figure 9:
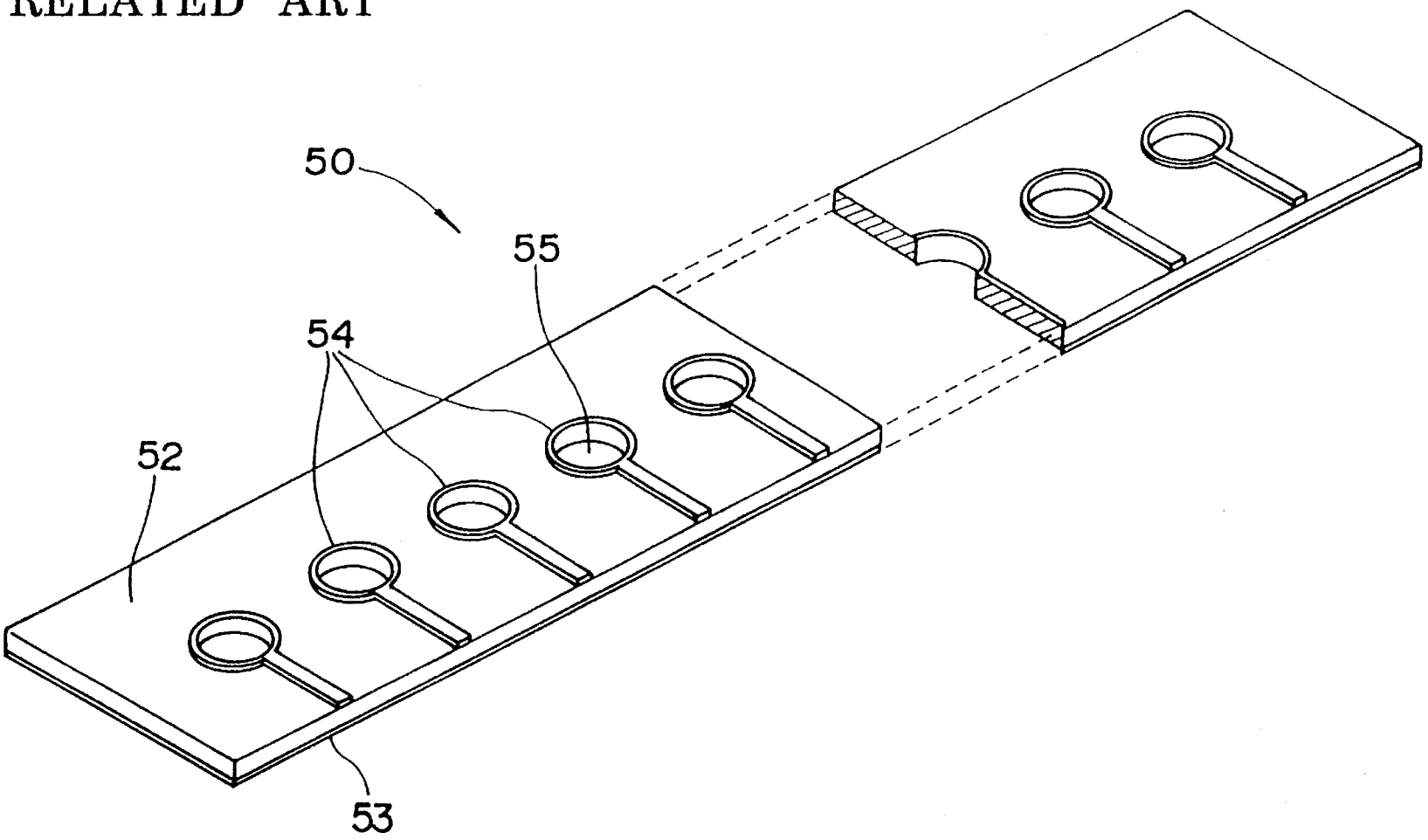
Fig.9 RELATED ART
FIG. 9 is a perspective view of an aperture electrode member of a conventional image forming apparatus.
Figure 10A:
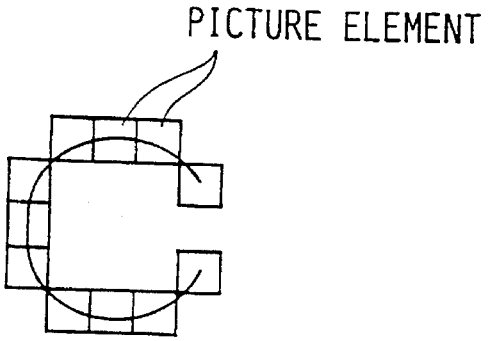
Fig.10 A RELATED ART
FIGS. 10A and 10B are explanatory diagrams for a conventional areal gradation method, where
Figure 10B:
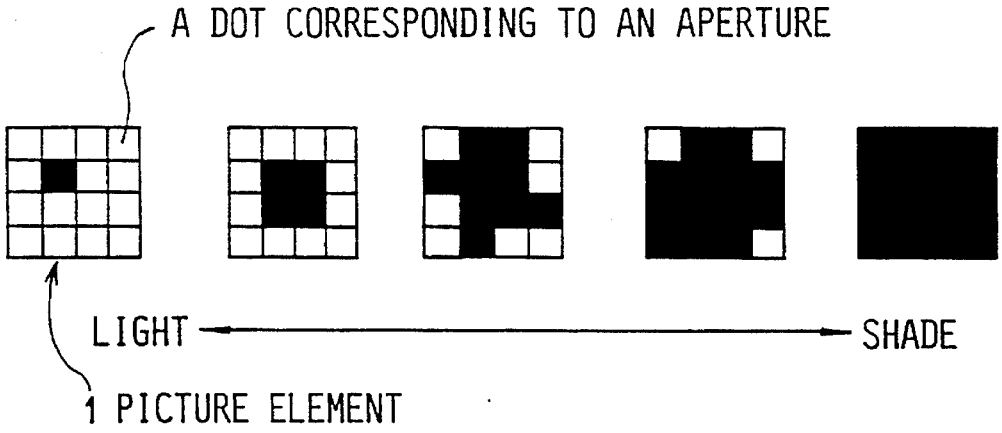
Fig.10B RELATED ART

The aperture electrode member 71 has the structure shown in FIG. 7. It comprises a polyimide insulating sheet 72 of 25 μm thickness, plural apertures 55 of 100 μm diameter which are arranged in a row on the insulating sheet 72, and a control electrode 74 of 1 μm thickness which is formed at the upper side of each aperture 75. The aperture electrode member 71 is so disposed that the control electrodes 74 face the image support member 63 side and the insulating sheet 72 is in contact with the toner 67 on the toner carry roller 69 at the positions of the apertures 75 as shown in FIG. 6. Alternatively, the control electrodes 84 can be embedded in the insulating sheet 82 as shown in FIG. 8.

In addition, a control voltage applying circuit 15 is connected between the control electrodes 74 and the toner carry roller 69. The control voltage applying circuit 15 is so designed that a voltage of 0 or +50 volts is applied to the control electrodes 74 on the basis of the image signal. Like the first embodiment, the control voltage applying circuit of this embodiment comprises the pulse generating unit 11, the applying unit 12, the control unit 13 and the control voltage source 14 and it is operated in the same manner as the first embodiment.

In addition, a direct-current power source 10 is connected between the backside (counter) electrode roller 62 and the toner carry roller 69 and the direct-current power source 10 is so designed that a high voltage of +1 kV is applicable to the backside electrode roller 62.

The image forming apparatus of the second embodiment operates as follows.

First, upon rotation of the toner carry roller 69 and the supply roller 68 in the directions indicated by the arrows of FIG. 6, the toner 67 is fed from the supply roller 68 and is rubbed against the toner carry roller 69 to be negatively charged and thence carried on the toner carry roller 69. The toner 67, carried on the toner carry roller 69 is thinly layered by the layer restricting blade 70 and further charged to then be fed toward the aperture electrode member 71 by the rotation of the toner carry roller 69. Thereafter, the toner 67 on the toner carry roller 69 is supplied to the lower side of the apertures 75 while being rubbed against the insulating sheet 72 of the aperture electrode member 71.

At this time, the control voltage applying circuit applies a voltage of +50 V to the control electrodes 74 located at an image portion in accordance with the image signal. As a result, lines of electric force which extend from the control electrodes 74 to the toner carry roller 69 are formed due to the potential difference between the control electrodes 74 and the toner carry roller 69 in the vicinity of the apertures 75 located at the image portion. With the lines of electric force thus formed, the negatively-charged toner is supplied with an electrostatic force directed to a high potential position. Thus, it is electrostatically attracted from the toner carry roller 69 through the apertures 75 to the control electrodes 74. The attracted toner 67 is further allowed to fly toward the image support member 63 by an electric field which is generated between the image support member 63 and the aperture electrode member 71 due to the voltage applied to the backside electrode roller 62 and is then deposited on the image support member 63 to form picture elements.

The control electrodes 74, located at an non-image portion, are supplied with a voltage of 0 V from the control voltage applying circuit 15. As a result, no electric field is formed between the toner carry roller 69 and the control electrodes 74. Therefore, the toner 67 on the toner carry roller 69 is supplied with no electrostatic force and it is not passed through the apertures 75.

The image support member 63 is fed by a distance corresponding to one picture element in a direction orthogonal to the aperture array during a period when a row of picture elements are formed on the image support member 63. The above process is repeated to form a toner image on the whole surface of the image support member. Thereafter, the toner image thus formed is fixed onto the image support member 63 by the fixing device 65.

In the image forming apparatus thus structured, insulation between the toner carry roller 69 and the control electrodes 74 is maintained using insulating toner and the apertures 55 suffer no breakdown.

The operation of the control voltage applying circuit 15 for forming a toner image having gradation representation on the image support member 63 is similar to that of the first Embodiment.

This invention is not limited to the above embodiments, and various modifications may be made to the above embodiments without departing from the subject matter of this invention.

For example, in the second embodiment, the control voltage for the apertures at the non-image portion is set to 0

V, however, it may be set to a negative voltage. In this case, an image whose fog is more depressed can be obtained. Further, in the above embodiments, the aperture electrode member is used as the toner flow control means. However, a mesh-like electrode member, as disclosed in U.S. Pat. No. 5,036,341, may be used.

As described above, according to the invention, the toner is repetitively supplied onto the image support member a plurality of times, the number of which corresponds to the pulse number generated in accordance with the image density of the image signal so that the output image having gradation representation can be obtained without degrading the resolution.

What is claimed is:

1. An image forming apparatus comprising:

an insulator layer;

a base electrode;

a plurality of control electrodes, each of said control electrodes formed individually and associated with the insulator layer so that said control electrodes are insulated from one another and at least a portion of said insulator layer is disposed between said plurality of control electrodes and said base electrode;

a plurality of apertures, one of said apertures formed for each of said control electrodes, each of said apertures penetrating through corresponding control electrodes and said insulator layer;

supply means for supplying charged toner in a vicinity of the plurality of apertures;

pulse generating means for generating a number of pulses for each of the plurality of apertures corresponding to density data of an image signal which is supplied from an external source, said pulse generating means comprising:

timing control means for generating a first timing signal and a second timing signal, clock generating means for generating a reference clock signal, memory means for storing a plurality of portions of said image signal in response to said first and said second timing signals, and rate multiplying means for inputting said plurality of portions of said image signal and for converting each of said plurality of portions of said image signal to a corresponding pulse signal based on said second timing signal and said reference clock signal, each pulse signal corresponding to one of said plurality of control electrodes and the corresponding aperture; and control voltage applying means for applying a control voltage between each of the plurality of control electrodes and the base electrode based on the corresponding pulse signal to control an amount of the charged toner supplied to an image support member, the amount of charged toner supplied by each control electrode based on the corresponding pulse signal output from said rate multiplying means.

2. The image forming apparatus as claimed in claim 1, wherein said plurality of control electrodes are formed on a surface of said insulator layer and said base electrode is a reference electrode mounted to said insulator layer on a surface opposite to the surface having said plurality of control electrodes, said apertures further penetrating through said reference electrode.

3. The image forming apparatus as claimed in claim 1, wherein said plurality of control electrodes are embedded in said insulator layer and said base electrode is a toner carry member mounted in the image forming apparatus to contact a surface of said insulator layer.

4. The image forming apparatus as claimed in claim 1, wherein said plurality of control electrodes are formed on a surface of said insulator layer and said base electrode is a toner carry member mounted in the image forming apparatus to contact a surface of said insulator layer opposite to the surface having said plural control electrodes.

5. The image forming apparatus as claimed in claim 4, wherein said toner carry member is a roller.

6. The image forming apparatus as claimed in claim 1, wherein, for each of said plurality of control electrodes, the control voltage is applied as a series of pulses based on the corresponding pulse signal output from said rate multiplying means.

7. The image forming apparatus as claimed in claim 1, wherein, for each of said plurality of control electrodes, the control voltage is applied as a single pulse having a width proportional to a pulse number of the corresponding pulse signal output from said rate multiplying means.

8. A method for controlling image density in an image forming apparatus using an aperture electrode having an insulating layer, a base electrode associated with the aperture electrode, a plurality of control electrodes associated with the insulating layer so that at least a portion of said insulating layer is disposed between said plurality of control electrodes and said base electrode, and a plurality of apertures corresponding to the plurality of control electrodes, each of said apertures passing through a corresponding one of the control electrodes and the insulating layer, wherein charged toner is supplied in a vicinity of the plurality of apertures, the method comprising the steps of:

inputting a control signal from an image data generating device to the image forming apparatus;

inputting a plurality of image data signals to the image forming apparatus;

converting the control signal into a first timing signal and a second timing signal;

generating a reference clock signal;

converting the plurality of image data signals to a plurality of parallel data signals equal in number to the plurality of apertures based on the first and second timing signals;

converting each of the plurality of parallel data signals to a pulse signal based on the second timing signal and the reference clock signal; and applying a control voltage between each control electrode and the base electrode to control an amount of the charged toner supplied to an image support member, the control voltage for each control electrode based on a corresponding one of the plurality of pulse signals.

9. The method as claimed in claim 8, wherein said plurality of control electrodes are formed on a surface of said insulating layer and said base electrode is a reference electrode mounted to said insulator layer on a surface opposite to the surface having said plurality of control electrodes, said apertures further penetrating through said reference electrode.

10. The method as claimed in claim 8, wherein said plurality of control electrodes are embedded in said insulating layer and said base electrode is a toner carry member mounted in the image forming apparatus to contact a surface of said insulating layer.

11. The method as claimed in claim 8, wherein said plurality of control electrodes are formed on a surface of said insulator layer and said base electrode is a toner carry roller mounted in the image forming apparatus to contact a surface of said insulator layer opposite to the surface having said plural control electrodes.

12. The method as claimed in claim 8, wherein, for each of said plurality of control electrodes, the control voltage is applied at each pulse of the corresponding pulse signal.

13. The method as claimed in claim 8, wherein, for each of said plurality of control electrodes, the control voltage is applied as a single pulse having a width proportional to a pulse number of the corresponding pulse signal.

14. An image forming apparatus that controls image density using an aperture electrode having at least an insulating layer, a base electrode associated with the aperture electrode, a plurality of control electrodes associated with the insulating layer so that at least a portion of said insulating layer is disposed between said plurality of control electrodes and said base electrode, and a plurality of apertures corresponding to the plurality of control electrodes, each of said apertures passing through a corresponding one of the control electrodes and the insulating layer, wherein charged toner is supplied in a vicinity of the plurality of apertures, the image forming apparatus comprising:

means for receiving a control signal from an image data generating device;

means for converting the control signal to a first timing signal and a second timing signal;

means for generating a reference clock signal;

means for receiving a plurality of image data signals;

means for converting the plurality of image data signals to a plurality of parallel data signals equal to the plurality of apertures based on the first and second timing signals;

means for converting each parallel data signal of the plurality of parallel data signals to a pulse signal based on the second timing signal and the reference clock signal; and means for applying a control voltage between each control electrode and the base electrode to control an amount of the charged toner supplied to an image support member, the control voltage for each control electrode based on a corresponding one of the plurality of pulse signals.

15. The apparatus as claimed in claim 14, wherein, for each of said plurality of control electrodes, the control voltage is applied at each pulse of the corresponding pulse signal.

16. The apparatus as claimed in claim 14, wherein, for each of said plurality of control electrodes, the control voltage is applied as a single pulse having a width proportional to a pulse number of the corresponding pulse signal.

17. The apparatus as claimed in claim 14, wherein said plurality of control electrodes are formed on a surface of said insulating layer and said base electrode is a reference electrode mounted to the insulating layer on a surface opposite to the surface having said plurality of control electrodes, the apertures further passing through the reference electrode.

18. The apparatus as claimed in claim 14, wherein said plurality of control electrodes are formed on a surface of said insulator layer and said base electrode is a toner carry roller mounted in the image forming apparatus to contact a surface of said insulator layer opposite to the surface having said plural control electrodes.

19. The apparatus as claimed in claim 14, wherein said plurality of control electrodes are embedded in said insulating layer and said base electrode is a toner carry member mounted in the image forming apparatus to contact a surface of said insulating layer.

20. The image forming apparatus as claimed in claim 1, wherein said memory means further comprising means for converting said plurality of portions of said image signal into a plurality of parallel data signals based on said first and said second timing signals.

21. The image forming apparatus as claimed in claim 1,, wherein said first timing signal is input to said memory means to shift said plurality of data signals into said memory means.

22. The image forming apparatus as claimed in claim 1, wherein said rate multiplying means further comprises a plurality of rate multipliers connected to said memory means.

23. The image forming apparatus as claimed in claim 22, wherein said second timing signal is input to said memory means to clear said memory means and is input to said plurality of rate multipliers to set said plurality of rate multipliers, each of said plurality of rate multipliers corresponding to one of said plurality of apertures.

24. The image forming apparatus as claimed in claim 1, wherein said control voltage applying means further comprises a plurality of controllable switches connected between a voltage source and a corresponding one of the control electrodes, a control input of each controllable switch connected to said rate multiplying means for inputting a corresponding one of said plurality of pulse signals.

* * * * *